US005901543A

United States Patent [19]

Anthony

[11] Patent Number: 5,901,543

[45] Date of Patent: May 11, 1999

[54] INDEPENDENTLY CONTROLLED-BRUSH MOTOR FOR OPEN-END SPINNING MACHINE AND METHOD

[76] Inventor: Phillip K. Anthony, 783 Rhymes La., Pickens, S.C. 29671

[21] Appl. No.: 08/975,296

[22] Filed: Nov. 20, 1997

[51] Int. Cl.[6] ..... D01H 11/00

[52] U.S. Cl. ..... 57/301; 57/406

[58] Field of Search ..... 57/301, 406, 408, 57/409, 410, 411, 412, 413, 92; 15/296.5; 198/496

[56] References Cited

U.S. PATENT DOCUMENTS

| | | | |
|---|---|---|---|
| 3,777,329 | 12/1973 | Lane | 57/301 |
| 3,884,028 | 5/1975 | Stahlecker et al. | 57/301 |
| 3,924,397 | 12/1975 | Stahlecker et al. | 57/301 |
| 3,959,961 | 6/1976 | Stahlecker | 57/301 |
| 4,098,065 | 7/1978 | Stahlecker et al. | 57/301 |
| 4,162,556 | 7/1979 | Van Ditshuizen et al. | 57/301 |
| 4,483,135 | 11/1984 | Kurushima et al. | 57/301 |
| 5,694,758 | 12/1997 | Anthony et al. | 57/301 |

*Primary Examiner*—William Stryjewski
*Attorney, Agent, or Firm*—Adams Law Firm, P.A.

[57] ABSTRACT

A method of reducing trash recirculation into the fiber formation stream of an open-end spinning machine yarn formation station in an open-end spinning machine of the type having a movable trash belt which collects trash removed from sliver during yarn formation, the spinning machine having a predetermined, relatively high, conventional trash belt speed "X", and a predetermined optimum trash brush rotational speed "Y". The method includes the steps of moving the trash belt at a low speed "Z" determined by the type of trash contained in the fiber, the type of yarn being spun and the type of fabric to be formed from the yarn, but in no event more than 50 percent of the conventional trash belt speed "X", and rotating the trash brush at optimum speed "Y" without regard to the speed "Z" of the trash belt.

10 Claims, 8 Drawing Sheets

INDEPENDENTLY CONTROLLED-BRUSH MOTOR FOR OPEN-END SPINNING MACHINE AND METHOD

TECHNICAL FIELD AND BACKGROUND OF THE INVENTION

This invention relates to an independently-controlled brush for cleaning a variable-speed trash belt for an open-end spinning machine and a method of cleaning the trash belt of an open-end spinning machine. As described below, careful control of the rate of movement of the trash belt improves both machine efficiency and yarn quality. While doing so, it has been recognized that maintaining relatively high cleaning brush speed is desirable for maintaining a high level of belt cleaning efficiency.

In the open-end spinning process the fibers to be spun into a yarn on the machine are removed from a sliver supplied to the machine, separated, and then spun into a yarn in the rotor or other yarn-producing mechanism. Each machine contains numerous adjacent stations. The opening of the sliver into individual fibers occurs in opening devices of varying types which reside in upstream fiber-flow proximity to the rotor. Typically, an opening roller having spikes or sawteeth on its circumference rotates in the opening device. It is these spikes or sawteeth that comb or tease the fibers out of the sliver.

At the input end of the station the sliver is drawn from a sliver can or bobbin into the opening device by a feed roller. An intake opening guide plate is pressed against the feed roller with a predetermined spring force. The trash contained in the sliver, which may include dust, seeds, insect fragments and neps, is forced out of the sliver by the opening roller and is physically separated from the fibers.

Trash content varies in type and quantity depending on where the cotton was grown, the growing season and the price of cotton. Heavy trash, sometimes known as "pepper trash", usually comprises crushed cotton seeds, plant stems, and any other hard raw material which might be processed in the early cleaning stages of the cotton. Usually, some quantity will remain up through carding. Medium trash comprises pulverized leaves, dirt and twigs. Light trash is made up of dust, short and immature fibers, smaller variations of both heavy and medium trash and other natural impurities.

The density of the trash is relatively high in comparison with the density of the fibers. The trash therefore gains greater kinetic energy than the fibers as the fibers and trash are carried into the radial outer region of the gap between the opening roller and housing wall. This tends to separate the trash from the fiber by centrifugal force as the trash moves outwardly at a greater rate and with greater energy than the fibers.

A discharge opening is located below the opening roller through which the trash falls. The trash is collected on a moving endless trash belt which is intended to carry the trash to one end of the machine, where a cleaning element, such as a brush roller, removes the trash from the belt. The cleaned belt rotates continually, so that each area of the belt alternates through successive trash-accumulating and trash-cleaning cycles.

Ideally, the belt has a fibrous nap to which the trash clings until it reaches the trash removal area at one end of the machine. However, after a relatively short period of time the nap on the belt becomes worn and progressively less able to physically retain the trash on its surface along the length of the machine. Vibration, air currents and other conditions can therefore cause some of this loose trash on the belt to be sucked back into the discharge opening or other access opening of a downstream station as the trash is carried along the length of the machine towards the trash removal area.

Reintroduction of trash into the fiber stream can cause the yarn to break or form slubs, which is usually sensed by stop-motion devices on the machine. At this point, the yarn must be pieced up either manually or automatically. This clearly reduces machine efficiency by stopping the output of yarn from the station until piece-up is completed. Even smaller trash which does not cause the yarn to break decreases the quality of the yarn by reintroducing trash into the yarn.

It has been noticed in the mill environment that during times of belt stoppage due to malfunction, machine efficiency increased somewhat, but to applicants' knowledge the reason for this was not appreciated. Applicants also believe that for a time the trash belt of a Schlafhorst SE-9 was manually stopped by overriding safety circuits in recognition that machine efficiency increased somewhat. To applicants' knowledge, this practice was abandoned because operators either forgot to stop the belts at the proper intervals or, after stopping them, forgot to restart them.

In addition, applicants are aware of at least one machine that was equipped for a short period of time with a single phase to three phase AC inverter which was capable of varying the trash belt speed, but which did not work satisfactorily, was not supported by the machine manufacturer, was removed and its use abandoned.

Previous applications of applicant, Ser. Nos. 08/711,879 and 08/898,453, disclose a method of increasing yarn quality and machine efficiency by either slowing the trash belt speed or operating the trash belt intermittently. The Schlafhorst open-end spinning machines on which the invention is practiced drives both the trash belt and trash brush off of a single drive motor. Thus, in slowing the trash belt to achieve the advantages which are the subject of these earlier applications, the speed of rotation of the trash brush is also slowed.

It has been discovered by further mill studies and quality reviews that yarn quality and efficiency can be further increased by maintaining the brush speed of rotation at a predetermined high level even as the speed of the trash belt is lowered. Thus, this application discloses independent control of the trash belt and trash brush in order to optimize the efficiency of both.

The invention according to this application represents a satisfactory and cost-effective solution to the problems described above. The practice of the invention can be varied within wide parameters to take into account mill conditions, sliver quality and trash content, machine and trash belt age and condition. Empirical use of the invention permits optimized operation of the open-end machine and high quality yarn without increased cost. Operation of the trash brush at a relatively high speed not only cleans the trash belt more efficiently, but keeps the trash belt properly refurbished by maintaining the nap of the trash belt in a raised condition. As trash falls onto the raised nap of the trash belt, it tends to be grabbed by and cling to the trash belt until removed by the brush, as described below.

SUMMARY OF THE INVENTION

Therefore, it is an object of the invention to provide a low-speed trash belt for an open end spinning machine which increases open-end spinning machine efficiency while maintaining the trash brush speed at an optimum high level.

It is another object of the invention to provide a low-speed trash belt for an open end spinning machine which increases open-end spinning machine efficiency and an independently-controlled trash brush which can therefore operate at an optimum high speed of rotation.

It is another object of the invention to provide a mode of operating the trash brush in such a manner as to maintain the napped surface of the trash belt in a raised condition which maizes trash retention.

It is another object of the invention to provide an open-end spinning machine which has trash belts which are driven independently of trash brushes which clean the trash belts so that they each can be operated at optimum speeds without regard to the speeds of the other.

It is another object of the invention to provide a method for optimizing the efficiency of operation of the trash belts and the trash brushes.

These and other objects of the present invention are achieved in the preferred embodiments disclosed below by providing a method of reducing trash recirculation into the fiber formation stream of an open-end spinning machine yarn formation station in an open-end spinning machine of the type having a movable trash belt which collects trash removed from sliver during yarn formation, the spinning machine having a predetermined, relatively high, conventional trash belt speed "X", and a predetermined optimum trash brush rotational speed "Y", comprising the steps of moving the trash belt at a low speed "Z" determined by the type of trash contained in the fiber, the type of yarn being spun and the type of fabric to be formed from the yarn, but in no event more than 50 percent of the conventional trash belt speed "X" and rotating the trash brush at speed "Y" without regard to the speed "Z" of the trash belt. The trash from the trash belt is cleaned by the rotating trash brush as the trash belt moves at the low trash bell speed "Z."

According to one preferred embodiment of the invention, the method includes the step of rotating the trash brush at optimum cleaning speed with drive means mechanically and electrically independent of the trash belt.

According to another preferred embodiment of the invention, the method includes the steps of driving the trash belt with a trash belt motor and rotating the trash brush with a trash brush motor.

According to yet another preferred embodiment of the invention, the method of the invention includes the steps of rotating the trash brush at a constant speed without regard to the speed of the trash belt.

According to one preferred embodiment of the invention, an open-end spinning machine of the type characterized by having at least one endless trash belt extending along the length of the machine for collecting trash removed from fibers being spun into yarn for delivery to a trash collection point and removing the trash from the trash belt at the trash collection point with a trash brush, the improvement comprising a trash belt motor operatively connected to the trash belt for driving the trash belt and a trash brush motor operatively connected to the trash brush for rotating the trash brush.

According to yet another preferred embodiment of the invention, the invention includes trash brush speed adjustment means for adjusting the speed of rotation of the trash brush.

According to yet another preferred embodiment of the invention, the trash brush speed adjustment means comprises a gear-box operatively positioned between the trash brush motor and the trash brush and electrical motor control means for varying the speed of rotation of the trash brush motor.

Preferably, the electrical motor control means comprises an inverter.

According to one preferred embodiment of the invention, in an open-end spinning machine of the type characterized by having at least one endless trash belt extending along the length of the machine for collecting trash removed from fibers being spun into yarn for delivery to a trash collection point, and a trash brush for removing the trash from the trash belt at the trash collection point, the improvement comprises drive means for controlling the speed of the trash belt and the speed of rotation of the trash brush independently of each other.

According to yet another preferred embodiment of the invention the drive means comprises a trash belt drive shaft having a trash belt-carrying belt pulley mounted thereon and an endless trash belt carried on the pulley, a trash belt drive motor operatively connected to the trash belt drive shaft for movement of the trash belt mounted on the pulley; a trash brush drive shaft having a trash brush mounted for rotation therewith in cleaning engagement with the trash belt, and a trash brush drive motor operatively connected to the trash brush drive shaft for rotating the trash brush mounted thereon at a predetermined optimum speed of rotation.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
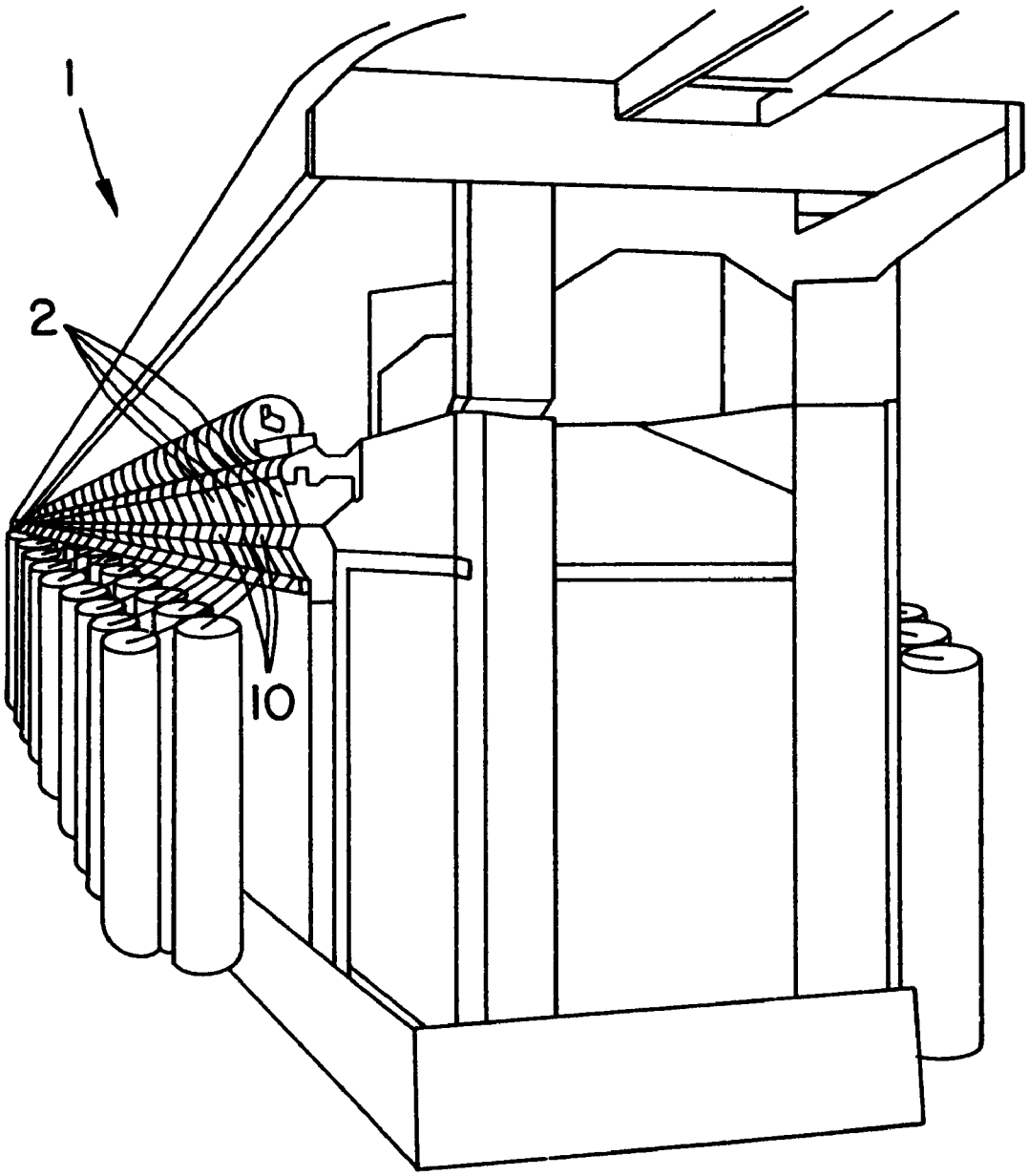
FIG. 1 PRIOR ART
FIG. 1 is a simplified perspective view of an open-end spinning machine.

Referring now specifically to the drawings, a conventional open-end spinning machine according to the present invention is illustrated in FIG. 1 and shown generally at reference numeral 1. For purposes of illustration the invention is described with reference to a Schlafhorst Model SE-9 open-end spinning machine, broadly illustrated in FIG. 1. However, the invention is equally applicable to other machines which utilize trash belts to carry away trash removed from the sliver during yarn formation on the machine.

Spinning machine 1 includes numerous adjacent spinning stations 2 along the length of both sides of the machine 1.

Figure 2:
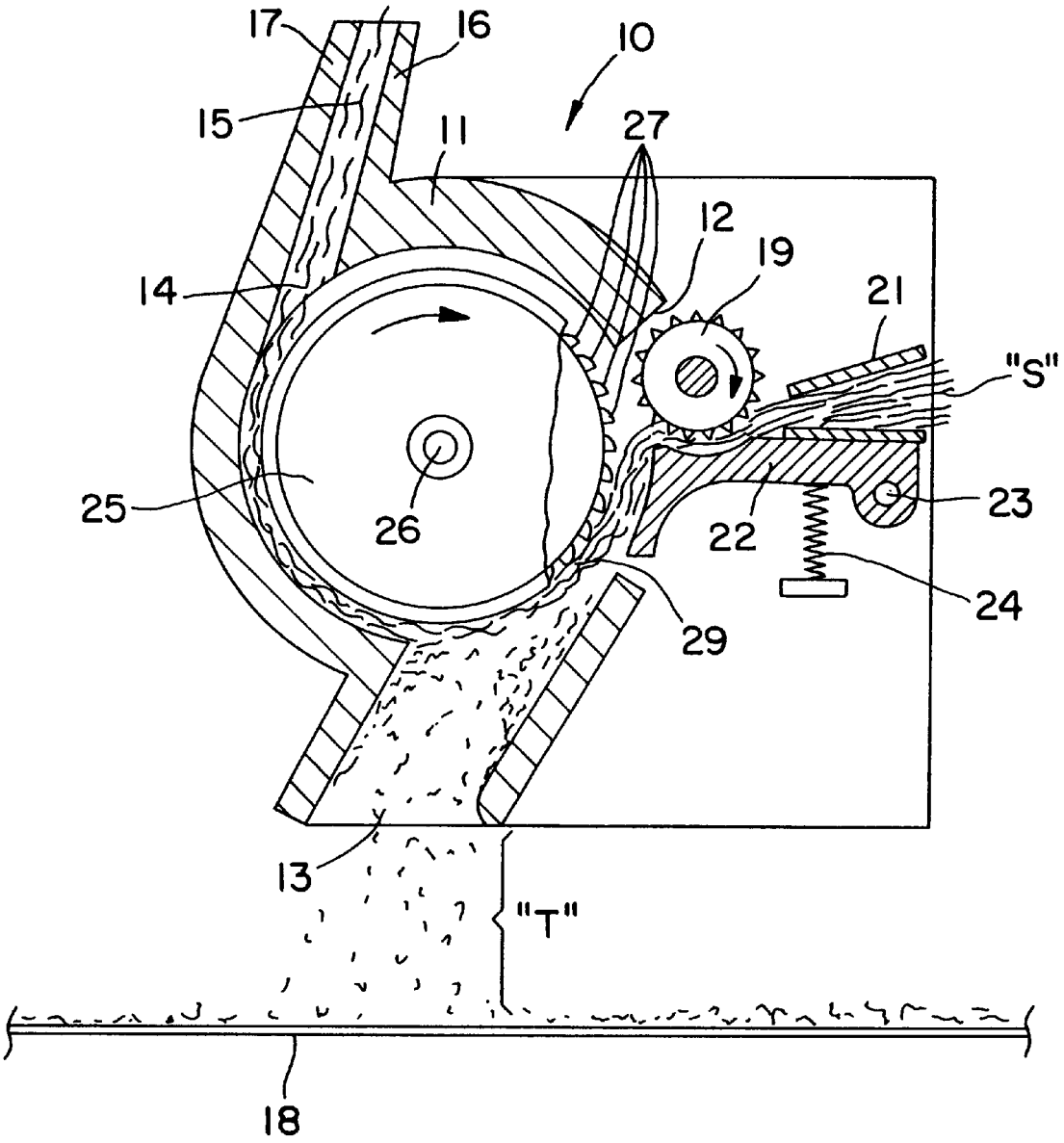
FIG. 2 is a cross-sectional view of an opening device on an open-end spinning machine of the type with which the invention is practiced.

Referring now to FIG. 2, each station 2 includes an opening device 10, which includes a housing 11 with an intake opening 12 for the sliver being formed into yarn. A trash discharge passage 13 and a fiber feeding opening 14 for feeding the separated fibers to the spinning rotor, not shown, through a fiber guide passage 15 is formed within walls 16 and 17. The trash discharge passage 13 extends downwardly and opens directly above a trash belt 18. Trash belt 18 is an endless conveyor-type belt which moves successively through a cycle where trash is deposited onto its surface and a cleaning cycle where a trash brush 40 sweeps the trash from the belt 18 for disposal. The trash belt 18 may be driven by its own motor, as in the Schlafhorst SE-9, or may be driven by the main machine drive, as in the Schlafhorst SE-8. See FIG. 10.

Figure 10:
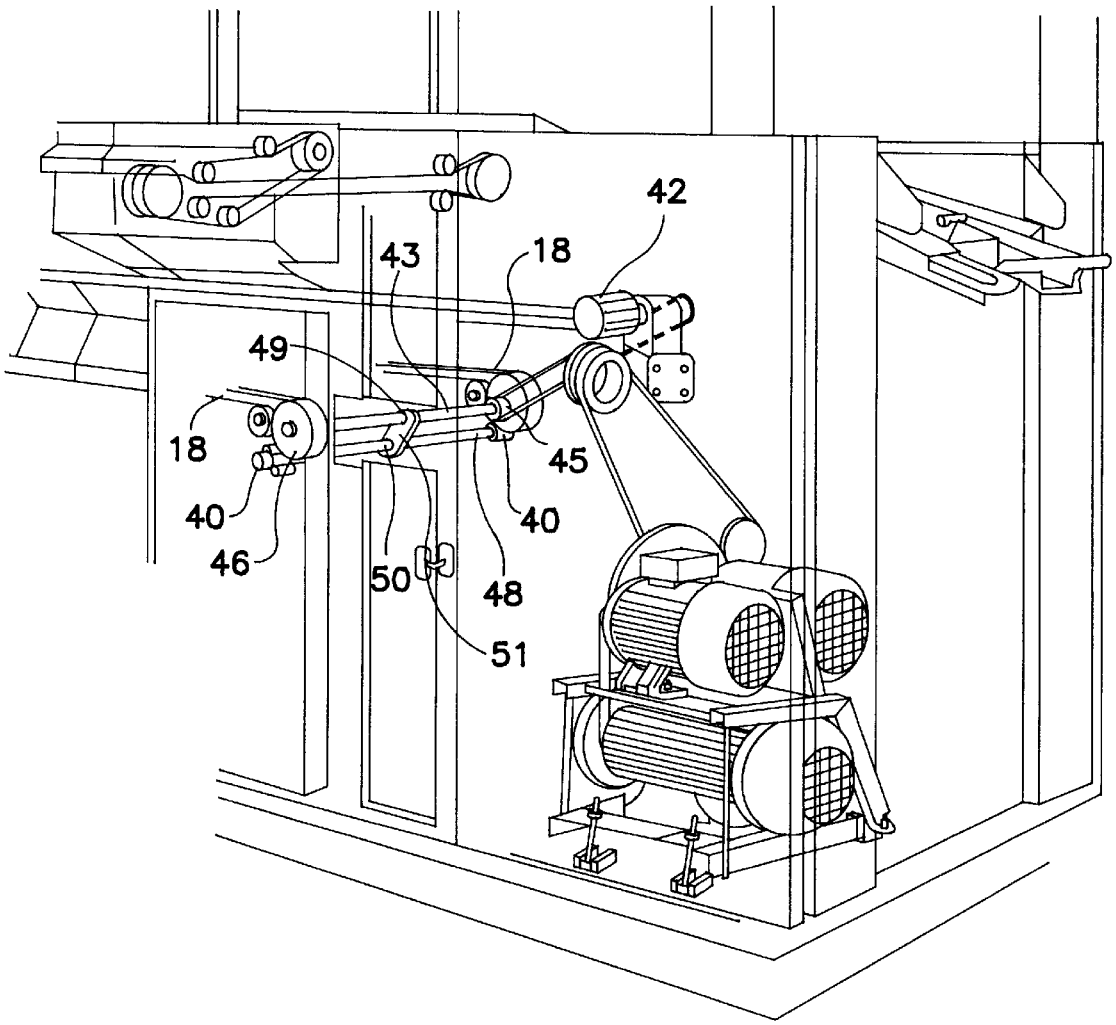
FIG. 10 PRIOR ART
FIG. 10 is a fragmentary perspective view of the drive end of a Schlafhorst open-end spinning machine with a conventional, prior art trash brush drive mechanism.

As is shown in FIG. 10 (prior art) trash belts 18 extend along both sides of the spinning machine 1. Each belt 18 is cleaned by its own trash brush 40. The trash brushes 40 each comprise a small, round core from which radially project stiff bristles. The brushes 40 each counter-rotate against the underside of respective trash belts 18 and remove trash which has not already fallen off.

A trash belt drive motor 42 drives a trash belt drive shaft 43 which carries trash belt drive pulleys 45, 46 on opposite ends. A trash brush drive shaft 48 is mounted for rotation in close proximity to the trash belt drive shaft 43 and is driven by means of a drive pulley 49 on the trash belt drive shaft 43 which drives a driven pulley 50 on the trash brush drive shaft 48 by means of an endless drive belt 51. The term "trash belt drive motor" is used to describe either the situation where as in the Schlafhorst SE-9 where the belts 18 are driven by their own motor, or the situation where the belts 18 are driven off of the main machine drive, as in the Schlafhorst SE-8.

As is apparent from the foregoing, in the prior art devices described above if the speed of the trash belts 18 is reduced, the speed of rotation of the trash brushes 40 will be correspondingly reduced.

A sliver feed roller 19, which rotates in a clockwise direction draws a sliver "S" under a compressor plate 21 through a movable intake opening guide plate 22 into the intake opening 12 of the housing 11. The intake opening guide plate 22 is pivotally supported on the housing wall by a pin 23 and urged by a spring 24 against the sliver feed roller 19.

In the housing 11, an opening roller 25 rotates in a counterclockwise direction on a shaft 26 which is supported in the housing 11. On its circumference, the opening roller 25 has an array of sawtooth-like combing elements 27 formed in a predetermined pattern on its outer circumference. These combing elements 27 comb individual fibers out of the sliver "S" as it is passed from under the sliver feed roller 19 into contact with the opening roller 25.

As a result of airflow induced in the housing 11, the separated fibers are entrained by the air flow and carried through the fiber guide passage 15 to the spinning unit. The trash "T" expelled from the stream of individual fibers normally has a greater density than the fibers and is therefore expelled centrifugally from the fibers into the trash discharge passage 13.

Note in FIG. 2 that the wall 16 is separated from the intake opening guide plate 22 by an opening 29. It has been determined that loose trash on the trash belt 18 can be reintroduced through this opening 29, through the trash discharge opening 13 or through other spaces back into the airflow within which the cleaned, separated fiber is moving in the fiber feeding opening 14. This is believed to occur as the result of the trash belt 18 moving along the length of the open-end spinning machine during machine operation, as described above.

Trash types and quantity in the cotton determines the speed at which the trash belt is optimally moved in order to obtain the highest practicable efficiency. The efficiency is also affected by having to remove yarn slubs or thick yarn sections, and having end breaks due to thin yarn with low tensile strength. Yarn trash is by far the leading factor in these inconsistencies.

Using as a base point that most SE-8 trash belts run normally at approximately 40–45 m/m and SE-9 trash belts run normally at approximately 60–65 m/m, machine efficiencies can be improved by running the belts at slower speeds. In general, speed variations should not extend outside of 5–50% of normal trash belt operating speed.

Figure 3:
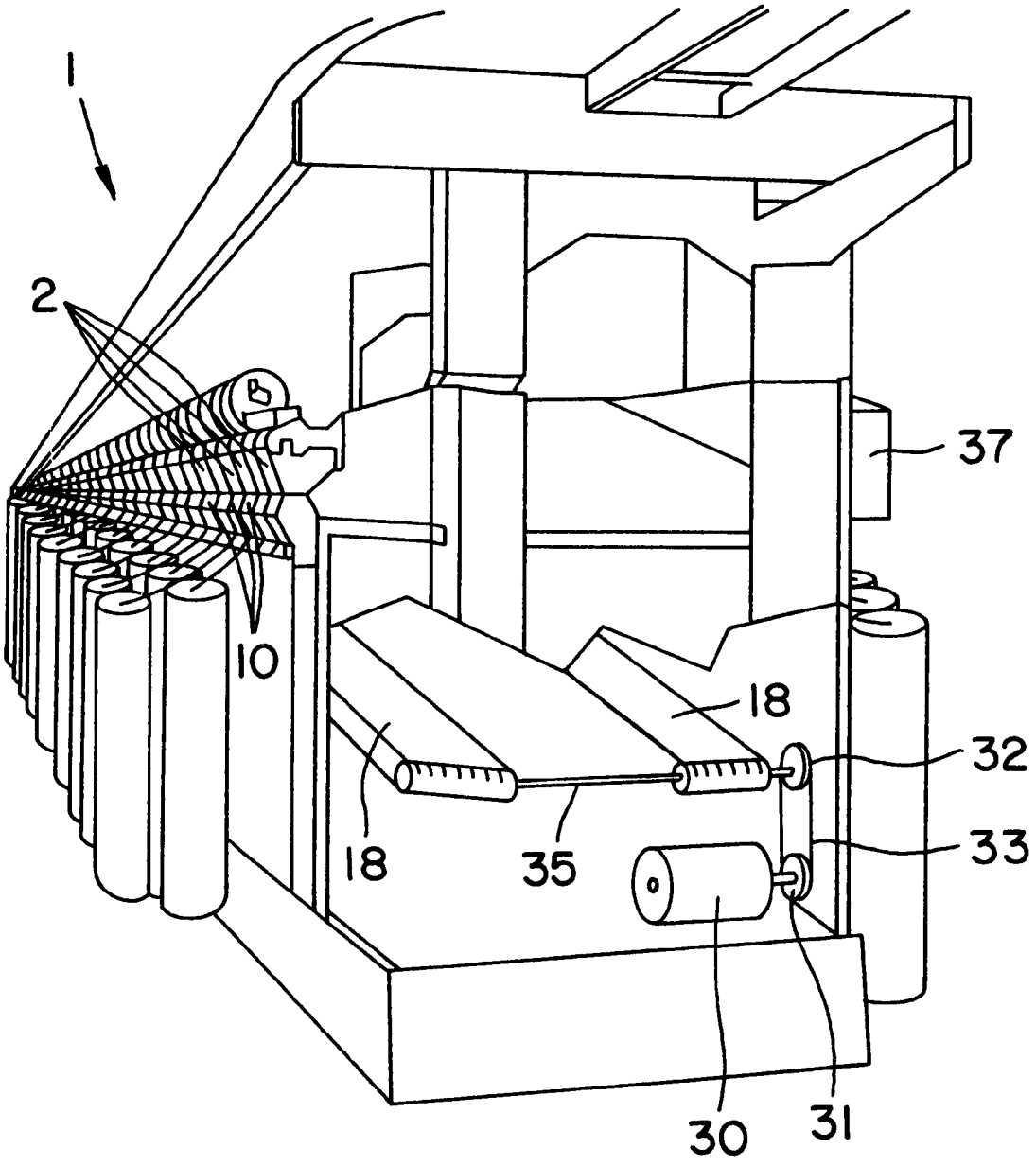
FIG. 3 is a view according to FIG. 1 with parts broken away to expose the trash belts and the motor drive for the trash belts.

Referring now to FIG. 3, the trash belts 18 of the open-end spinning machine 1 extend down the length of the machine frame from one end to the other. In the particular embodiment of open-end spinning machine used in this application for purposes of illustration, both belts 18 are driven by a single motor 30 through drive and driven pulleys 31 and 32 rotatably connected by a drive belt 33. The other belt 18 is rotated by a solid concentric shaft 35 extending from one belt 18 to the other. A typical motor 30 used for is application is a ⅓ HP constant frequency, 1750 rpm, 60 Hz, 3-phase AC motor.

Conventional machine operation requires that the belts 18 rotate continuously at a relatively high rate of travel, on the order of 59–60 meters per minute. The Schlafhorst SE-9 does not have a "Stop/Start" control for the trash belts 18. Rather, a safety circuit must be overridden.

Figure 4:
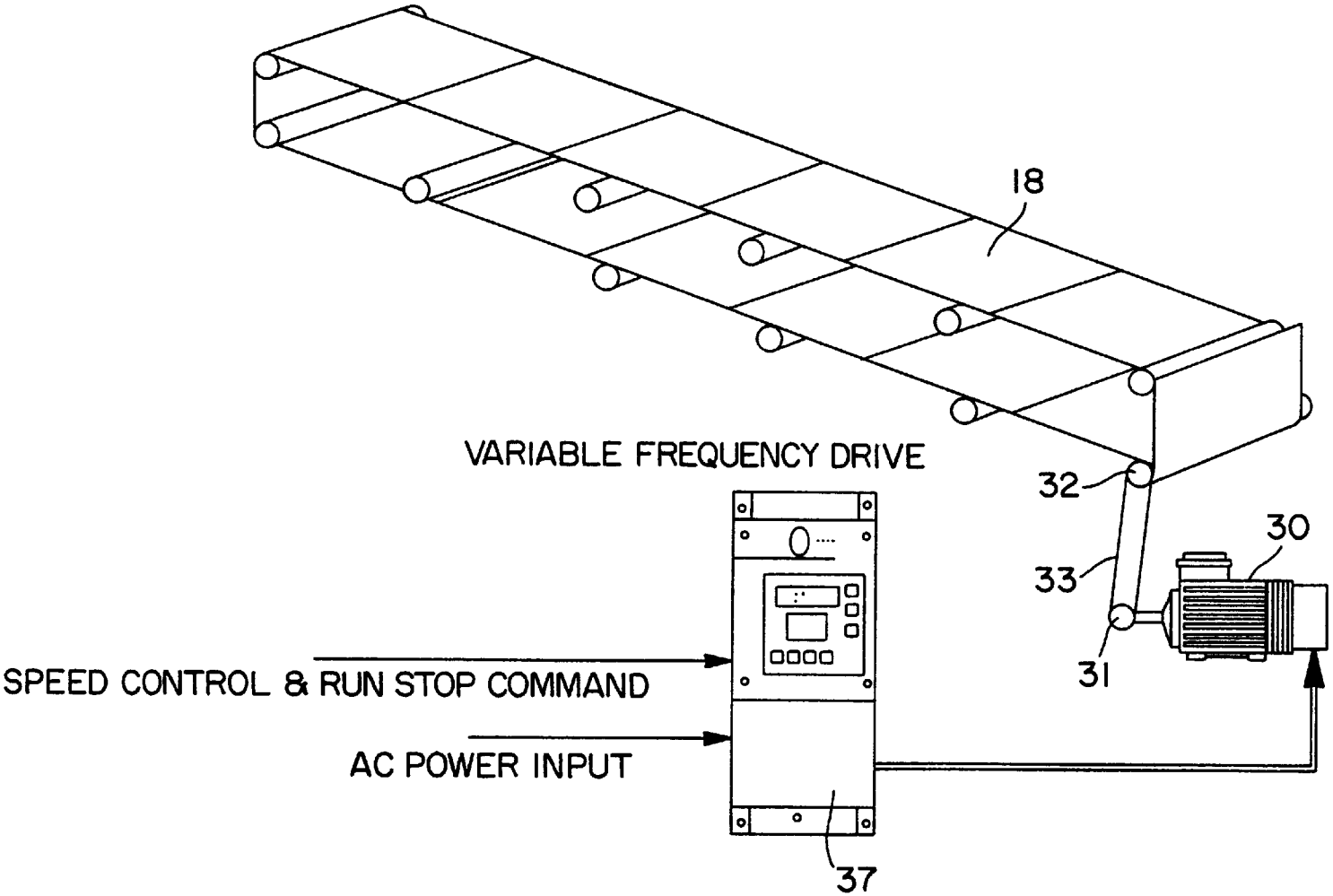
FIG. 4 is a schematic diagram showing the trash belt, motor and controller.

The trash belts 18, as shown in FIG. 4, illustrates that an adjustable frequency drive, or inverter, 37, is wired to the motor 30. A suitable inverter 37 is the General Electric AF-300 family of inverters, selected according to conventional selection criteria to match the particular motor 30 being controlled.

Inverter 37 is equipped with a control keypad which permits frequency selection, timing values and other status conditions. Such inverters 37 can dwell for up to 6,000 seconds, or 100 minutes. This permits a very wide range of speeds and time intervals between belt 18 movement cycles.

Alternatively, motor 30 can be controlled by controlling only voltage to the motor, or with a combination of voltage and frequency variation.

Inverter 37 can thus control the belts 18 in various ways. Several of these are shown in FIGS. 5–9, where time is plotted horizontally and velocity of the belts 18 vertically. For example, in FIG. 5 a "soft start" and "soft stop" profile is shown, where the inverter 37 "dwells", for example, 50–55 minutes each hour, and then gradually increases in speed from standstill to 15–20 meters/minute. The belts 18 move for from 5 to 10 minutes, or whatever other time empirical study has indicated will adequately clean the trash belts 18. The inverter 37 then gradually slows and finally stops for another 50–55 minutes.

Figure 6:
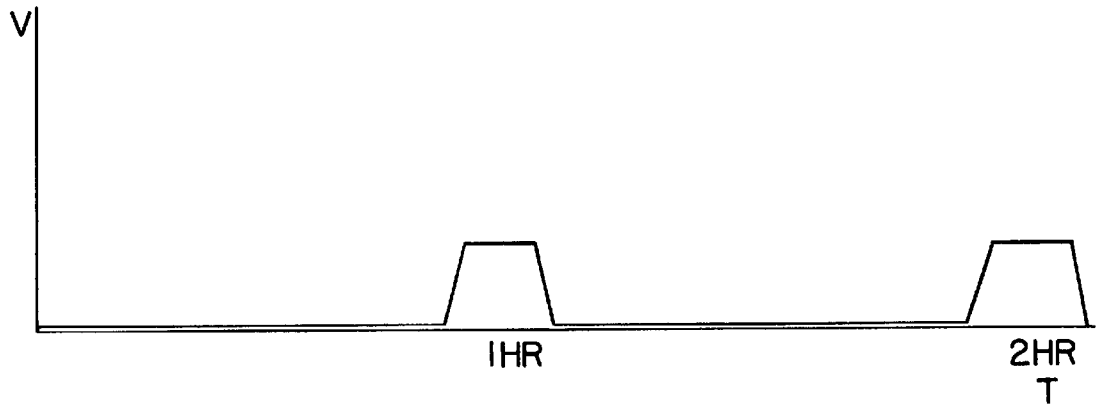

FIG. 6 illustrates that the belt 18 need not be started gradually, but can rapidly increase to the desired belt velocity.

Figure 5:
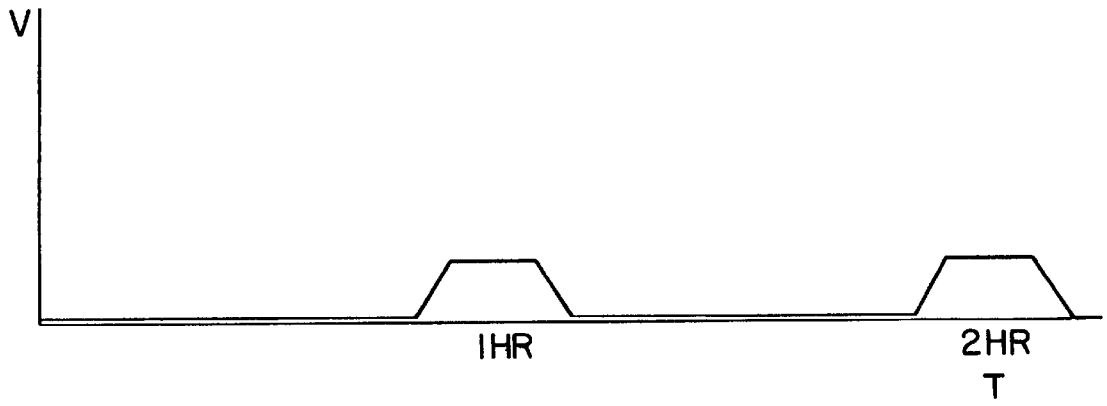
FIGS. 5–9 are tables plotting several examples of velocity and time profiles according to various embodiments of the invention.
Figure 7:
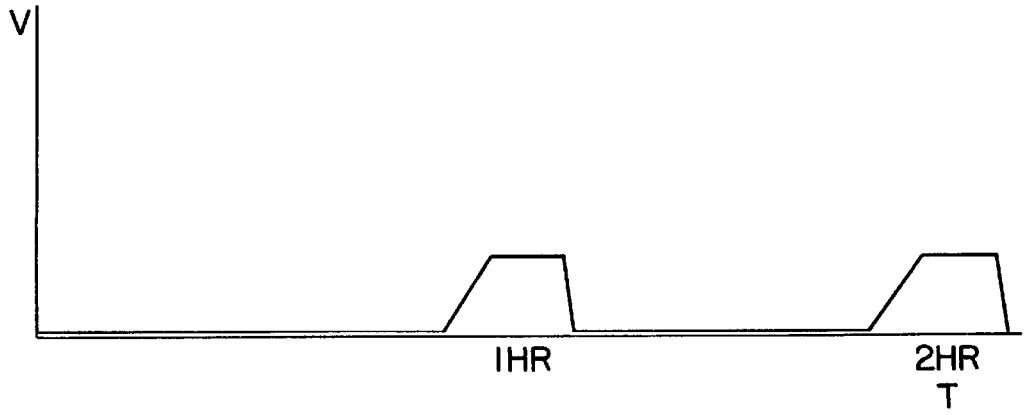

FIG. 7 illustrates that it may be desirable to start the belts 18 gradually, as in FIG. 5, but need not be stopped gradually.

Gradual start-up reduces the tendency of the sudden belt movement to shake loose or vibrate the trash off of the belts 18 and back into the air where it can be sucked into the yarn forming mechanisms, as described above. However, since the belts 18 are clean after the cleaning cycle, it makes little difference whether the belts 18 are stopped gradually or in the normal manner.

Figure 8:
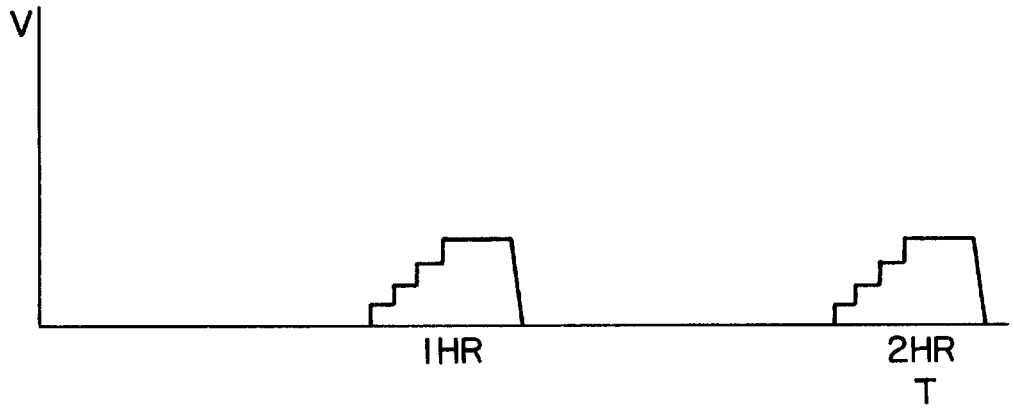

FIG. 8 illustrates that the start-up can be made incrementally, with pauses at two or more intermediate belt velocities. This is another form of "soft start."

Figure 9:
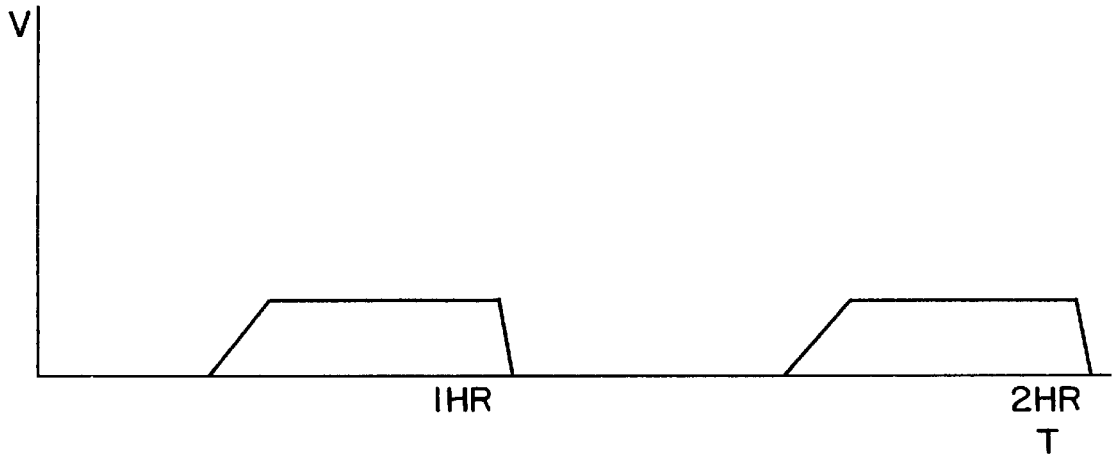

FIG. 9 illustrates that the predetermined rates of belt velocity and the predetermined periods of time can vary considerably. For example, in FIG. 9, the belt 18 is rotated for 30 minutes and stopped for 30 minutes, using the velocity profile shown in FIG. 5.

The appropriate time interval of belt movement is determined by first observing the number of revolutions of the belt 18 necessary to adequately clean it. This is then converted into time and input through the keypad on the inverter 37.

Applicants have determined that in most cases the conventional belt velocity is approximately three times too high without regard to the particular velocity profile used. Applicants have successfully designed and installed systems wherein the belts 18 are operated at approximately one-third the conventional belt velocity continuously with increased machine efficiency and yarn quality. This was accomplished by removing the belt pulley where the speed sensor is located and adding two more pick-up points. This causes the speed sensor to believe that the belts 18 are still rotating at the original speed.

An example of use of the method and apparatus is set out below:

Belt stopped time interval 30 minutes

Belt moving time interval 5 minutes

Belt velocity (meters/minute) 20 meters/minute

Inverter Model No. GE AF-300M$

The GE AF-300M$ inverter, Catalog No. D5564, is a 380/460 V, 1 HP Drive.

The rate of increase of belt velocity during "soft starts" is not critical, the point being to start the belt 18 sufficiently slowly to keep from shaking dust and trash into the air. It is believed that a "ramp up" to maximum belt velocity over 5–10 seconds fulfills this condition.

As noted above, the development of the invention took place on Schlafhorst SE-8 and SE-9 open-end spinning machines. The Schlafhorst SE-8 has a trash belt speed of approximately 40–45 m/m, and the Schlafhorst SE-9 has a trash belt speed of approximately 60–65 m/m.

More specifically, it has been determined that these trash belt speeds can be reduced as follows, based upon trash content:

Mostly heavy trash approx. 30–40% of normal speed

Mostly medium trash approx. 25–35% of normal speed

Mostly light trash approx. 15–25% of normal speed

Evenly mixture of trash approx. 20–30% of normal speed

Applicants have also determined that yarn count also affects the speed at which the trash belts 18 most efficiently operate. The majority of yarn counts range from a 5–6 heavy count, for example, denim used in manufacturing jeans, to a 35–40 light count used, for example, for the production of fine linens. Denim is usually woven of relatively cheap, dirty fiber, and this "roughness" is generally portrayed as desirable by the manufacturer. Linens, on the other hand, are generally produced from a much higher quality fiber, which has less trash in it to begin with. Therefore, the most efficient trash belt speed is determined by a further modification of the belt speed to take into account the yarn count. This has been determined to be in the range of 5–10%. To process heavier yarn counts, i.e., 5–6, belt speed would be increased by approximately 10%. Lighter yarn counts, i.e., 35–40, would process most efficiently by slowing the belt speed by up to 10%. Trials on counts between these ranges would suggest empirically an appropriate percentage increase or decrease in belt speed.

EXAMPLES

On a Schlafhorst SE-8 spinning machine:

| Yarn Type | Trash Belt Speed (m/m) |
|---|---|
| 5 count yarn for woven denim with heavy trash | 18 |
| 5 count yarn for woven denim with medium trash | 16 |
| 20 count yarn for shirtings with medium trash | 8 |
| 40 count yarn for fine linens with light trash | 6 |

On a Schlafhorst SE-9 spinning machine:

| Yarn Type | Trash Belt Speed (m/m) |
|---|---|
| 5 count yarn for woven denim with heavy trash | 27 |
| 5 count yarn for woven denim with medium trash | 24 |
| 20 count yarn for shirtings with medium trash | 12 |
| 40 count yarn for fine linens with light trash | 9 |

With this type of analysis, it appears that the trash belt can be operated continuously but at a speed very substantially lower than was heretofore thought possible. These speed reductions can be carried out by use of differing motor pulley size or motor speed, or by placing an inverter in the electrical circuit whereby the speed can be set electronically.

Figure 11:
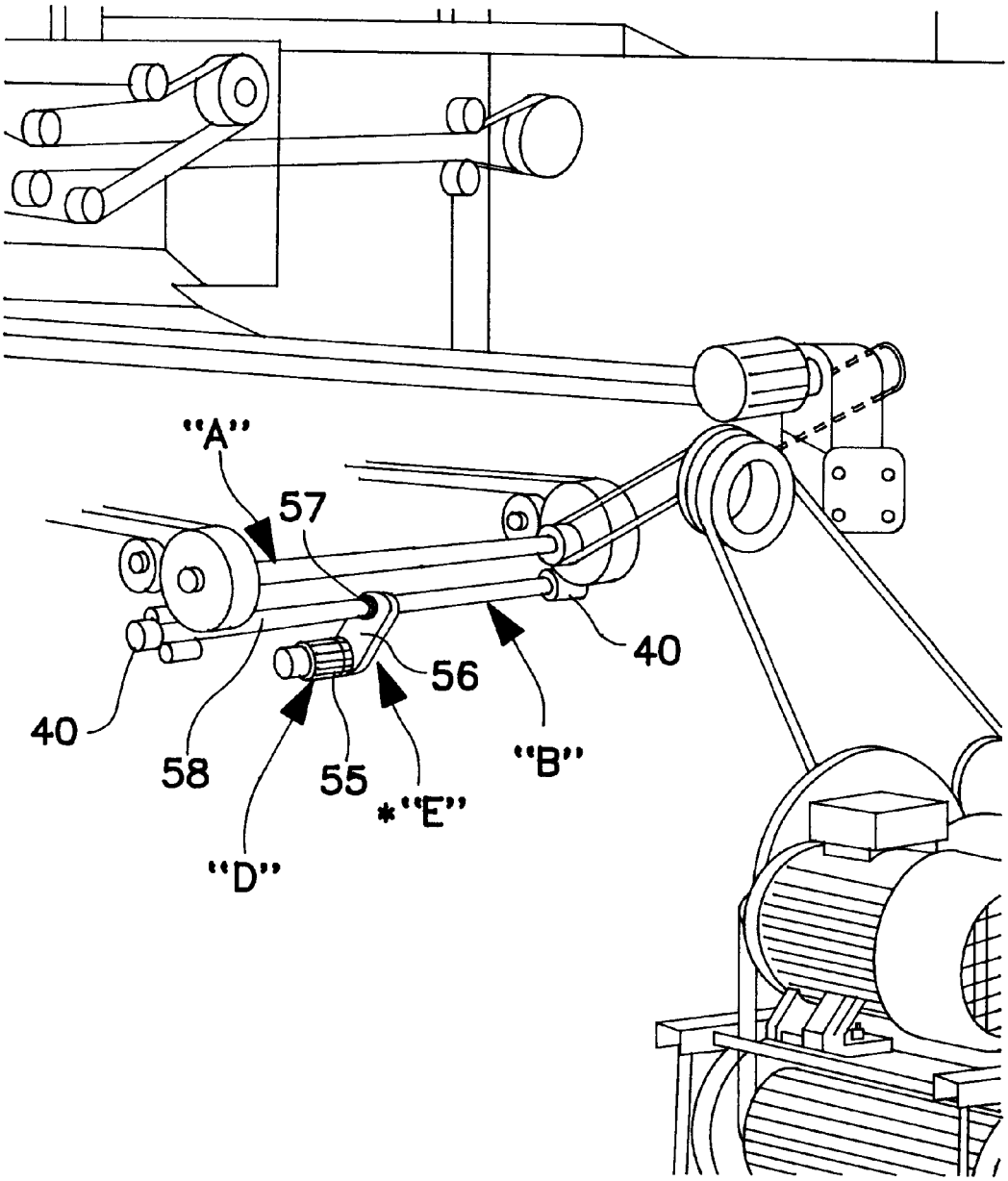
FIG. 11 is a fragmentary perspective view of the drive end of a Schlafhorst open-end spinning machine with an independently-driven trash brush according to an embodiment of the invention.

As noted above, prior art open-end spinning machines are designed so that the speed of rotation of the trash brushes 40 varies along with the speed of the trash belts 18. However, applicant has observed that belt cleaning efficiency is reduced along with reduction in the speed of rotation of the trash brushes 40. This results from the relatively small diameter of the brushes 40 and the relatively short distance over which the brushes 40 are in contact with the belts 18. Referring now to FIG. 11, a preferred embodiment of the invention is shown, wherein the brushes 40 are driven by a separate motor 55. The motor 55 drives a drive belt 56 which engages a driven pulley 57 fixed on a trash belt drive shaft 58. As shown, the trash brushes 40 are positioned on opposite ends of the drive shaft 58 and engage the underside of the trash belts 18 as they are turned by respective trash belt drive pulleys 45, 46. Thus, the speed of rotation of the trash brushes 40 may be adjusted for optimum cleaning efficiency completely without regard to the speed of the trash belts 18.

Motor 55 preferably may be a Dayton ⅓ hp, 3 phase, 1750 rpm AC induction motor with a suitable gear box and inverter for speed adjustment. A suitable speed of rotation of the brushes 40 has been determined to be 360 rpm without regard to the speed of the belts 18. However, the ability to vary the speed of rotation of the trash brushes without regard to the speed of the belts 18 means that both speeds may be independently optimized.

For example, on a prior art Schlafhorst SE-9 open-end spinning machine, reduction of trash belt speed from a conventional 65 m/m to an optimum speed of 15 m/m also results in a reduction of the speed of the trash brush 40 to 90 rpm. This trash brush speed is far too slow to effectively clean the trash belt 18. A typical trash brush 40 is 10 cm. in diameter, or 31 cm in circumference. At 360 rpm, the brush therefore has a surface speed at the brush tips of about 113 m/m. Reduction of the trash brush speed to 90 rpm results in a trash brush 40 surface speed of 28 m/m, or less than twice the surface speed of the trash belt 18. The ratio of surface speeds between the trash belt 18 and the trash brush 40 is therefore important both in belt-cleaning efficiency and belt-conditioning efficiency. It has been determined that the surface speed of the trash brush 40 should be 3–8 times that of the trash belt 18. So, for example, a trash belt 18 with a surface speed of 15 m/m and a trash brush 40 operating at 345–360 rpm (107–113 m/m) would result in a ratio of brush-to-belt surface speed of 7–7.4 to 1.

A constant speed brush for cleaning a variable-speed trash belt for an open-end spinning machine and a method of cleaning the trash belt of an open-end spinning machine is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A method of reducing trash recirculation into the fiber formation stream of an open-end spinning machine yarn formation station in an open-end spinning machine having a movable trash belt which collects trash removed from sliver during yarn formation, said spinning machine having a predetermined, relatively high, conventional trash belt speed "X", and a predetermined optimum trash brush rotational speed "Y", comprising the steps of:

(a) moving the trash belt at a low speed "Z" determined by the type of trash contained in the fiber, the type of yarn being spun and the type of fabric to be formed from the yarn, but at no time more than 50 percent of the conventional trash belt speed "X";

(b) rotating the trash brush at speed "Y" without regard to the speed "Z" of the trash belt;

(c) cleaning the trash from the trash belt with the rotating trash brush as the trash belt moves at the low trash belt speed "Z."

2. A method according to claim 1, wherein the step of rotating the trash brush at speed "Y" without regard to the speed "Z" of the trash belt includes the step of rotating the trash brush at speed "Y" with drive means mechanically and electrically independent of the trash belt.

3. A method according to claim 1, wherein the step of moving the trash belt includes the step of:

(a) driving the trash belt with a trash belt motor; and further wherein the step of rotating the trash brush includes the step of:

(b) rotating the trash brush with a trash brush motor.

4. A method according to claim 3, wherein the step of rotating the trash brush at speed "Y" without regard to the speed "Z" of the trash belt includes the step of:

(a) rotating the trash brush at a constant speed without regard to the speed of the trash belt.

5. In an open-end spinning machine having at least one endless trash belt extending along the length of the machine for collecting trash removed from fibers being spun into yarn for delivery to a trash collection point, and a trash brush for removing the trash from the trash belt at the trash collection point, the improvement comprising:

(a) a trash belt motor operatively connected to the trash belt for driving the trash belt at a speed determined empirically to result in optimum yarn output quality from the open-end spinning machine; and (b) a trash brush motor operatively connected to the trash brush for rotating the trash brush at a speed empirically determined to optimally clean trash from the trash belt independently of the optimal speed of movement of the trash belt.

6. In an open-end spinning machine according to claim 5, and including trash brush speed adjustment means for adjusting the speed of rotation of the trash brush.

7. In an open-end spinning machine according to claim 6, wherein said trash brush speed adjustment means comprises:

(a) a gear-box operatively positioned between said trash brush motor and said trash brush; and (b) electrical motor control means for varying the speed of rotation of the trash brush motor.

8. In an open-end spinning machine according to claim 7, wherein said electrical motor control means comprises an inverter.

9. In an open-end spinning machine having at least one endless trash belt extending along the length of the machine for collecting trash removed from fibers being spun into yarn for delivery to a trash collection point, and a trash brush for removing the trash from the trash belt at the trash collection point, the improvement comprising trash belt drive means for controlling the speed of the trash belt, and trash brush drive means for controlling the speed of rotation of the trash brush mechanically independently of the speed of rotation of the trash belt.

10. In an open-end spinning machine according to claim 9, wherein said trash belt drive means comprises:

(a) a trash belt drive shaft having a trash belt-carrying belt pulley mounted thereon and an endless trash belt carried on said pulley;

(b) a trash belt drive motor operatively connected to said trash belt drive shaft for movement of the trash belt mounted on said pulley;

and said trash brush drive means comprises:

(c) a trash brush drive shaft having a trash brush mounted for rotation therewith in cleaning engagement with the trash belt; and (d) a trash brush drive motor operatively connected to said trash blush drive shaft for rotating said trash brush mounted thereon at a predetermined optimum speed of rotation.

* * * * *